US008172010B2

(12) United States Patent
Strachan

(10) Patent No.: US 8,172,010 B2
(45) Date of Patent: May 8, 2012

(54) ROTARY DRILL BIT STEERABLE SYSTEM AND METHOD

(75) Inventor: Michael J. Strachan, The Woodlands, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 338 days.

(21) Appl. No.: 12/525,346

(22) PCT Filed: Feb. 1, 2008

(86) PCT No.: PCT/US2008/052798

§ 371 (c)(1),
(2), (4) Date: Jul. 31, 2009

(87) PCT Pub. No.: WO2008/097843

PCT Pub. Date: Aug. 14, 2008

(65) Prior Publication Data

US 2009/0321139 A1 Dec. 31, 2009

Related U.S. Application Data

(60) Provisional application No. 60/887,924, filed on Feb. 2, 2007.

(51) Int. Cl.
*E21B 10/43* (2006.01)

(52) U.S. Cl. ..... 175/391; 175/408; 175/61

(58) Field of Classification Search ..... 175/61, 175/391, 394, 408, 415, 426, 431
See application file for complete search history.

(56) References Cited

U.S. PATENT DOCUMENTS

| | | | | | |
|---|---|---|---|---|---|
| 3,825,083 | A * | 7/1974 | Flarity et al. | 175/394 |
| 4,640,375 | A * | 2/1987 | Barr et al. | 175/431 |
| 4,941,538 | A * | 7/1990 | King | 175/431 |
| 5,004,057 | A | 4/1991 | Tibbitts et al. | 175/408 |
| 6,123,160 | A * | 9/2000 | Tibbitts | 175/385 |
| 6,138,780 | A * | 10/2000 | Beuershausen | 175/408 |
| 6,173,797 | B1 * | 1/2001 | Dykstra et al. | 175/374 |
| 6,206,117 | B1 * | 3/2001 | Tibbitts et al. | 175/399 |
| 6,290,007 | B2 * | 9/2001 | Beuershausen et al. | 175/408 |
| 7,059,430 | B2 * | 6/2006 | Singh et al. | 175/339 |
| 7,308,955 | B2 * | 12/2007 | Barton et al. | 175/325.5 |
| 7,729,895 | B2 * | 6/2010 | Chen | 703/6 |
| 7,971,661 | B2 * | 7/2011 | Johnson et al. | 175/408 |

OTHER PUBLICATIONS

International Preliminary Report on Patentability; PCT/US2008/052798; pp. 6, Aug. 13, 2009.
International Search Report and Written Opinion; PCT/US2008/052798; pp. 9, Aug. 21, 2008.

* cited by examiner

*Primary Examiner* — Daniel P Stephenson
(74) *Attorney, Agent, or Firm* — Baker Botts L.L.P.

(57) ABSTRACT

A drill bit comprising: a cutting section comprising gage cutters, wherein in the cutting section is a first end of the bit, and wherein the cutting section has a full gage diameter; a heel section comprising a blade, wherein the heel section is at an end of the drill bit opposite the cutting section, and wherein a diameter of the heel section is a full gage diameter, wherein the blade has a high spiral around the drill bit; and a clearance section between the cutting and heel sections, wherein the clearance section comprises a diameter less than full gage, and wherein clearance section extends from the gage cutters of the cutting section to the blade of the heel section.

18 Claims, 9 Drawing Sheets

ROTARY DRILL BIT STEERABLE SYSTEM AND METHOD

CROSS REFERENCE TO RELATED APPLICATIONS

This application is a U.S. National Stage Application of International Application No. PCT/US2008/052798 filed Feb. 1, 2008, which designates the United States of America, and claims the benefit of U.S. Provisional Application No. 60/887,924, filed Feb. 2, 2007, the contents of which are hereby incorporated by reference in their entirety.

TECHNICAL FIELD

The present disclosure is related to wellbore drilling equipment and more particularly to rotary drill bits and/or bottom hole assemblies with steerability.

BACKGROUND

Various types of rotary drill bits have been used to form wellbores or boreholes in downhole formations. Such wellbores are often formed using a rotary drill bit attached to the end of a generally hollow, tubular drill string extending from an associated well surface. Rotation of a rotary drill bit progressively cuts away adjacent portions of a downhole formation using cutting elements and cutting structures disposed on exterior portions of the rotary drill bit. Examples of rotary drill bits include fixed cutter drill bits or drag drill bits, impregnated diamond bits and matrix drill bits. Various types of drilling fluids are generally used with rotary drill bits to form wellbores or boreholes extending from a well surface through one or more downhole formations.

Conventional borehole drilling in a controlled direction requires multiple mechanisms to steer drilling direction. Bottom hole assemblies have been used consisting of the drill bit, stabilizers, drill collars, heavy weight pipe, and a positive displacement motor (mud motor) having a bent housing. The bottom hole assembly is connected to a drill string or drill pipe extending to the surface. The assembly steers by sliding (not rotating) the assembly with the bend in the bent housing in a specific direction to cause a change in the borehole direction. The assembly and drill string are rotated to drill straight.

Other conventional borehole drilling systems use rotary steerable arrangements that use deflection to point-the-bit. They may provide a bottom hole assembly that may have a flexible shaft in the middle of the tool with an internal cam to bias the tool to point-the-bit. In these systems, an outer housing of the tool does not rotate with the drill string, but rather it may engage the sidewall of the wellbore to point-the-bit.

SUMMARY

In accordance with teachings of the present disclosure, rotary drill bits including fixed cutter drill bits may be designed with steerability and/or controllability optimized for a desired wellbore profile and/or anticipated downhole drilling conditions.

According to one aspect of the invention, there is provided a drill bit comprising: a cutting section comprising gage cutters, wherein in the cutting section is a first end of the bit, and wherein the cutting section has a full gage diameter; a heel section comprising a blade, wherein the heel section is at an end of the drill bit opposite the cutting section, and wherein a diameter of the heel section is a full gage diameter; and a clearance section between the cutting and heel sections, wherein the clearance section comprises a diameter less than full gage, and wherein clearance section extends from the gage cutters of the cutting section to the blade of the heel section.

Another aspect of the invention provides a drill bit comprising: a cutting section comprising gage cutters, wherein in the cutting section is a first end of the bit, and wherein the cutting section has a full gage diameter; a heel section comprising a blade, wherein the heel section is at an end of the drill bit opposite the cutting section, and wherein a diameter of the heel section is a full gage diameter, and wherein the blade has a high spiral around the drill bit; and a clearance section between the cutting and heel sections, wherein the clearance section comprises a diameter less than full gage.

According to a further aspect of the invention, there is provided a method for steering a rotary drill bit, the method comprising: running a bottom hole assembly and an articulating drill bit into a wellbore, wherein the drill bit comprises a cutting section, a heel section and a clearance section, wherein the cutting and heel sections comprise diameters about full gage and the clearance section comprises a diameter less than full gage; articulating the drill bit relative to the bottom hole assembly; and kicking the heel section of the drill bit off a wellbore side wall.

BRIEF DESCRIPTION OF THE DRAWINGS

A more complete and thorough understanding of the present disclosure and advantages thereof may be acquired by referring to the following description taken in conjunction with the accompanying drawings, in which like reference numbers indicate like features, and wherein.

DETAILED DESCRIPTION OF THE DISCLOSURE

Figure 1:
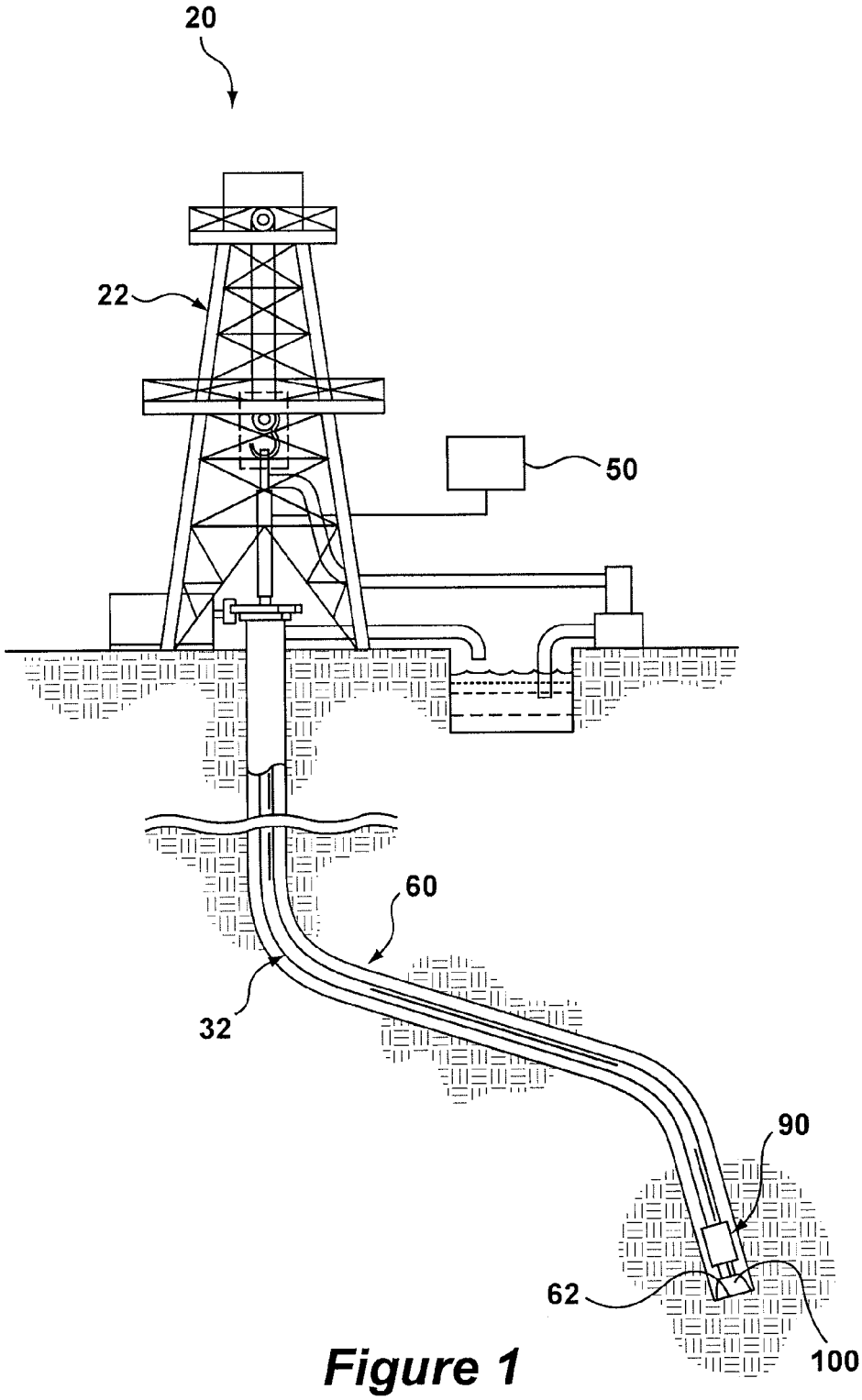
FIG. 1 is a schematic side view in section and in elevation with portions broken away showing one example of a directional wellbore which may be formed by a drill bit of the present disclosure.

Embodiments of the present disclosure may be understood by referring to FIGS. 1-7B, wherein like numerals may be used for like and corresponding parts of the various drawings.

The term "bottom hole assembly" or "BHA" may be used in this application to describe various components and assemblies disposed proximate to a rotary drill bit at the downhole end of a drill string. Examples of components and assemblies (not expressly shown) which may be included in a bottom hole assembly or BHA include, but are not limited to, a bent sub, a downhole drilling motor, a near bit reamer, stabilizers and down hole instruments. A bottom hole assembly may also include various types of well logging tools (not expressly shown) and other downhole instruments associated with directional drilling of a wellbore. Examples of such logging tools and/or directional drilling equipment may include, but are not limited to, acoustic, neutron, gamma ray, density, photoelectric, nuclear magnetic resonance and/or any other commercially available logging instruments.

The term "cutter" may be used in this application to include various types of compacts, inserts, milled teeth, welded compacts and gage cutters satisfactory for use with a wide variety of rotary drill bits. Impact arrestors, which may be included as part of the cutting structure on some types of rotary drill bits, may function as cutters to remove formation materials from adjacent portions of a wellbore. Impact arrestors or any other portion of the cutting structure of a rotary drill bit may be analyzed and evaluated using various techniques and procedures as discussed herein with respect to cutters. Polycrystalline diamond compacts (PDC) and tungsten carbide inserts may be used to form cutters for rotary drill bits. A wide variety of other types of hard, abrasive materials may also be satisfactorily used to form such cutters.

The terms "cutting element" and "cutlet" may be used to describe a small portion or segment of an associated cutter which interacts with adjacent portions of a wellbore and may be used to simulate interaction between the cutter and adjacent portions of a wellbore. As discussed later in more detail, cutters and other portions of a rotary drill bit may also be meshed into small segments or portions sometimes referred to as "mesh units" for purposes of analyzing interaction between each small portion or segment and adjacent portions of a wellbore.

The term "cutting structure" may be used in this application to include various combinations and arrangements of cutters, face cutters, impact arrestors and/or gage cutters formed on exterior portions of a rotary drill bit. Some fixed cutter drill bits may include one or more blades extending from an associated bit body with cutters disposed of the blades. Various configurations of blades and cutters may be used to form cutting structures for a fixed cutter drill bit.

The term "rotary drill bit" may be used in this application to include various types of fixed cutter drill bits, drag bits and matrix drill bits operable to form a wellbore extending through one or more downhole formations. Rotary drill bits and associated components formed in accordance with teachings of the present disclosure may have many different designs and configurations.

Various teachings of the present disclosure may also be used with other types of rotary drill bits having active or passive gages similar to active or passive gages associated with fixed cutter drill bits. For example, a stabilizer (not expressly shown) located relatively close to a roller cone drill bit (not expressly shown) may function similar to a passive gage portion of a fixed cutter drill bit. A near bit reamer (not expressly shown) located relatively close to a roller cone drill bit may function similar to an active gage portion of a fixed cutter drill bit.

The term "straight hole" may be used in this application to describe a wellbore or portions of a wellbore that extends at generally a constant angle relative to vertical. Vertical wellbores and horizontal wellbores are examples of straight holes.

The terms "slant hole" and "slant hole segment" may be used in this application to describe a straight hole formed at a substantially constant angle relative to vertical. The constant angle of a slant hole is typically less than ninety (90) degrees and greater than zero (0) degrees.

Most straight holes such as vertical wellbores and horizontal wellbores with any significant length will have some variation from vertical or horizontal based in part on characteristics of associated drilling equipment used to form such wellbores. A slant hole may have similar variations depending upon the length and associated drilling equipment used to form the slant hole.

The term "directional wellbore" may be used in this application to describe a wellbore or portions of a wellbore that extend at a desired angle or angles relative to vertical. Such angles are greater than normal variations associated with straight holes. A directional wellbore sometimes may be described as a wellbore deviated from vertical.

Sections, segments and/or portions of a directional wellbore may include, but are not limited to, a vertical section, a kick off section, a building section, a holding section and/or a dropping section. A vertical section may have substantially no change in degrees from vertical. Holding sections such as slant hole segments and horizontal segments may extend at respective fixed angles relative to vertical and may have substantially zero rate of change in degrees from vertical. Transition sections formed between straight hole portions of a wellbore may include, but are not limited to, kick off segments, building segments and dropping segments. Such transition sections generally have a rate of change in degrees greater than zero. Building segments generally have a positive rate of change in degrees. Dropping segments generally have a negative rate of change in degrees. The rate of change in degrees may vary along the length of all or portions of a transition section or may be substantially constant along the length of all or portions of the transition section.

The term "kick off segment" may be used to describe a portion or section of a wellbore forming a transition between the end point of a straight hole segment and the first point where a desired DLS or tilt rate is achieved. A kick off segment may be formed as a transition from a vertical wellbore to an equilibrium wellbore with a constant curvature or tilt rate. A kick off segment of a wellbore may have a variable curvature and a variable rate of change in degrees from vertical (variable tilt rate).

A building segment having a relatively constant radius and a relatively constant change in degrees from vertical (constant tilt rate) may be used to form a transition from vertical segments to a slant hole segment or horizontal segment of a wellbore. A dropping segment may have a relatively constant radius and a relatively constant change in degrees from vertical (constant tilt rate) may be used to form a transition from a slant hole segment or a horizontal segment to a vertical segment of a wellbore. See FIG. 1A. For some applications a transition between a vertical segment and a horizontal segment may only be a building segment having a relatively constant radius and a relatively constant change in degrees from vertical. See FIG. 1B. Building segments and dropping segments may also be described as "equilibrium" segments.

The terms "dogleg severity" or "DLS" may be used to describe the rate of change in degrees of a wellbore from vertical during drilling of the wellbore. DLS is often measured in degrees per one hundred feet (°/100 ft). A straight hole, vertical hole, slant hole or horizontal hole will generally have a value of DLS of approximately zero. DLS may be positive, negative or zero.

Referring to FIG. 1, a cross-sectional side view of a wellbore and directional drilling equipment is shown. Directional drilling system 20 and wellbore 60 as shown in FIG. 1 may be used to describe various features of the present disclosure, including drill rig 22, drilling string 32, bottom hole assembly 90 and associated rotary drill bit 100.

Bottom hole assembly 90 may include various components associated with a measurement while drilling (MWD) system that provides logging data and other information from the bottom of wellbore 60 to directional drilling equipment 50. Logging data and other information may be communicated from end 62 of wellbore 60 through drill string 32 using MWD techniques and converted to electrical signals at well surface 24. Electrical conduit or wires 52 may communicate the electrical signals to directional drilling equipment 50. Bottom hole assembly 90 may have a flexible shaft in the middle of the tool with an internal cam to bias the tool to point-the-bit. An outer housing of the tool does not rotate with the drill string, but rather it may engage the sidewall of the wellbore to point-the-bit.

Figure 2A:
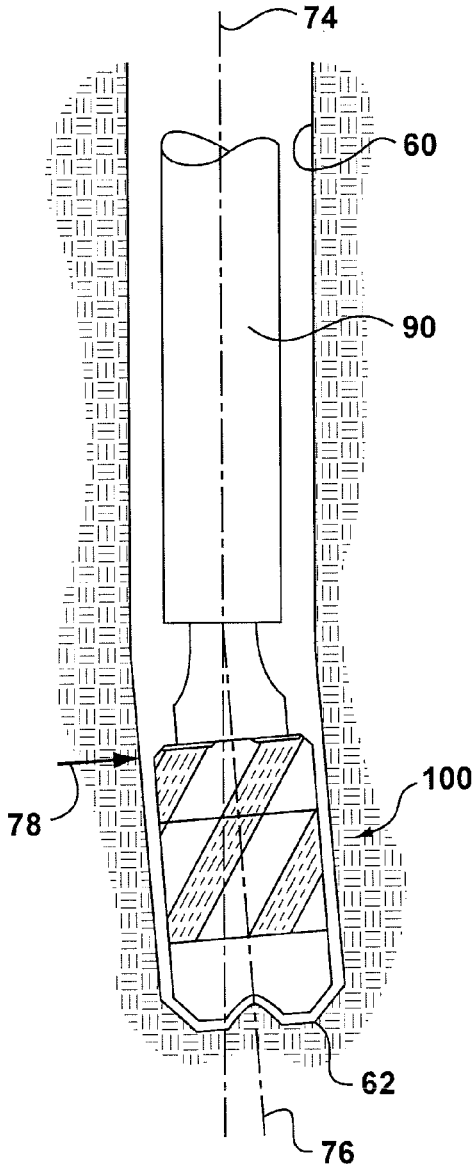
FIG. 2A is a side view of a bottom hole assembly and bit in a wellbore.

Referring to FIG. 2A, a side view of a rotary drill bit steerable system of the present invention is illustrated. Rotary drill bit 100 extends from bottom hole assembly 90 to the end 62 of wellbore 60. Bottom hole assembly 90 is aligned with vertical axis 74 while rotary drill bit 100 is aligned with rate of penetration axis 76. Kick-off load 78 is applied by the side wall of wellbore 60 on a heel portion of rotary drill bit 100 to point-the-bit in the direction of rate of penetration axis 76.

Figure 2B:
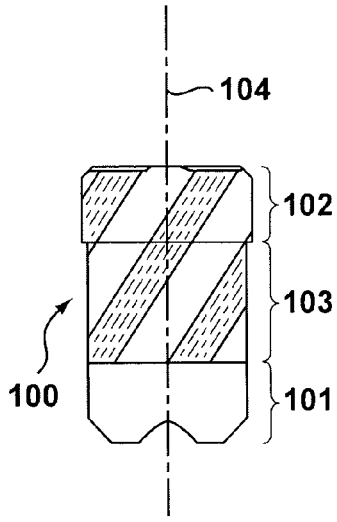
FIG. 2B is a side view of the bit illustrated in FIG. 2A.

FIG. 2B illustrates a side view of the rotary drill bit shown in FIG. 2A. Rotary drill bit 100 has cutting section 101, heel section 102 and clearance section 103. Cutting section 101 may have a full gage diameter at its widest portions. Similarly, heel section 102 may also have a full gage diameter. Clearance section 102 may have a diameter less than full gage, so that its diameter may be less than cutting section 101 and heel section 102.

Further, where the blade profiles in heel section 102 are designed for increased surface area contact with the side wall of the borehole, the point load of the blades on the formation may be reduced, whereby the propensity of the blades to sidecut the side wall may also be reduced. The blades in heel section 102 may be wider than the spaces between the blades and the spiral of the blades may be sufficiently high so that a larger blade surface area is in contact with the side wall of the wellbore at the fulcrum point. A larger area of surface contact by the blades on the side wall of the wellbore may distribute kick-off load 78 over a larger portion of the side wall of the wellbore so that the point loads across the contact area is reduced.

Figure 3A:
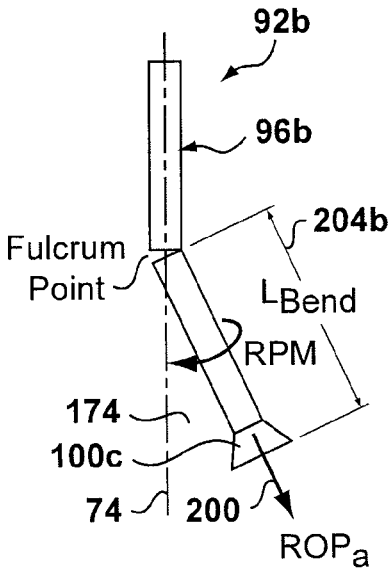
FIG. 3A is a graphical representation showing portions of a point-the-bit directional drilling system forming a directional wellbore.

FIG. 3A shows portions of bottom hole assembly 90 disposed in a generally vertical section of wellbore 60*a* as rotary drill bit 100*c* begins to form kick off segment 60*b*. Bottom hole assembly 90*b* includes rotary drill bit steering unit 92*b* which may provide one portion of a point-the-bit directional drilling system.

Point-the-bit directional drilling systems typically form a directional wellbore using a combination of axial bit penetration, bit rotation and bit tilting. Point-the-bit directional drilling systems may not produce side penetration such as described with respect to steering unit 92*b* in FIG. 3A. Therefore, bit side penetration is generally not created by point-the-bit directional drilling systems to form a directional wellbore. One example of a point-the-bit directional drilling system is the Geo-Pilot® Rotary Steerable System available from Sperry Drilling Services at Halliburton Company.

Figure 3B:
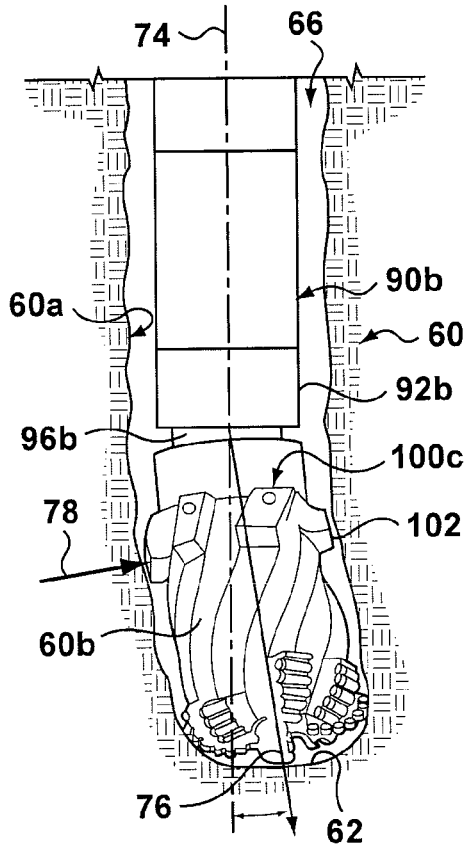
FIG. 3B is a schematic drawing in section and in elevation with portions broken away showing one example of a point-the-bit directional drilling system adjacent to the end of a wellbore.

FIG. 3B is a graphical representation showing various parameters associated with a point-the-bit directional drilling system of the present invention. Steering unit 92*b* will generally include bent subassembly 96*b*. A wide variety of bent subassemblies may be satisfactorily used to allow drill string 32 (not shown) to rotate drill bit 100*c* while bent subassembly 96*b* directs or points drill bit 100*c* at an angle away from vertical axis 74. Some bent subassemblies have a constant "bent angle" 174 (see FIG. 3A). Other bent subassemblies have a variable or adjustable "bent angle". Bend length 204*b* is a function of the dimensions and configurations of associated bent subassembly 96*b*.

As shown in FIG. 3B, bottom hole assembly 90*b* is aligned with vertical axis 74 while rotary drill bit 100*c* is aligned with rate of penetration axis 76. Kick-off load 78 is applied by the side wall of wellbore 60 on a heel section 102 of rotary drill bit 100*c* to point-the-bit in the direction of rate of penetration axis 76. In a steering mode, the bottom hole assembly 90*b* causes load 78 to be applied to heel section 102 of the drill bit. heel section 102 acts as a fulcrum point.

If heel section 102 has a full gage 105 diameter, same as cutting section 101, the bit may be able to take full advantage of kick-off load 78 being applied by the side wall of wellbore 60 to point-the-bit in a new direction. High spiral blades in heel section 102 may enable almost constant contact between the side wall of wellbore 60 and heel section 102 so as to generate a maximum kick-off load 78 without eroding the side wall. Further, where the bit has a smaller than full gage diameter in clearance section 103, the bit may obviate sticking problems observed with bits that are full gage over the entire length of the bit.

As previously noted, side penetration of rotary drill bit will generally not occur in a point-the-bit directional drilling system. Arrow 76 represents the rate of penetration along rotational axis of rotary drill bit 100*c*.

Increasing the diameter of the heel section at the fulcrum point may allow for generation of greater side force to steer the bit. The drilling system may be a point-the-bit rotary steerable system or a downhole motor using a long gage bit, for example, a slickbore. The increased generation of greater side force to steer the bit due to an increased diameter of the heel section may be independent of blade surface area and spiral in the heel section. By increasing the diameter of the heel section, kick-off load 78 may be greater compared to a similar down hole bit having a relatively smaller diameter at the heel section. An increased diameter at the heel section may allow for greater dogleg capability.

Figure 3C:
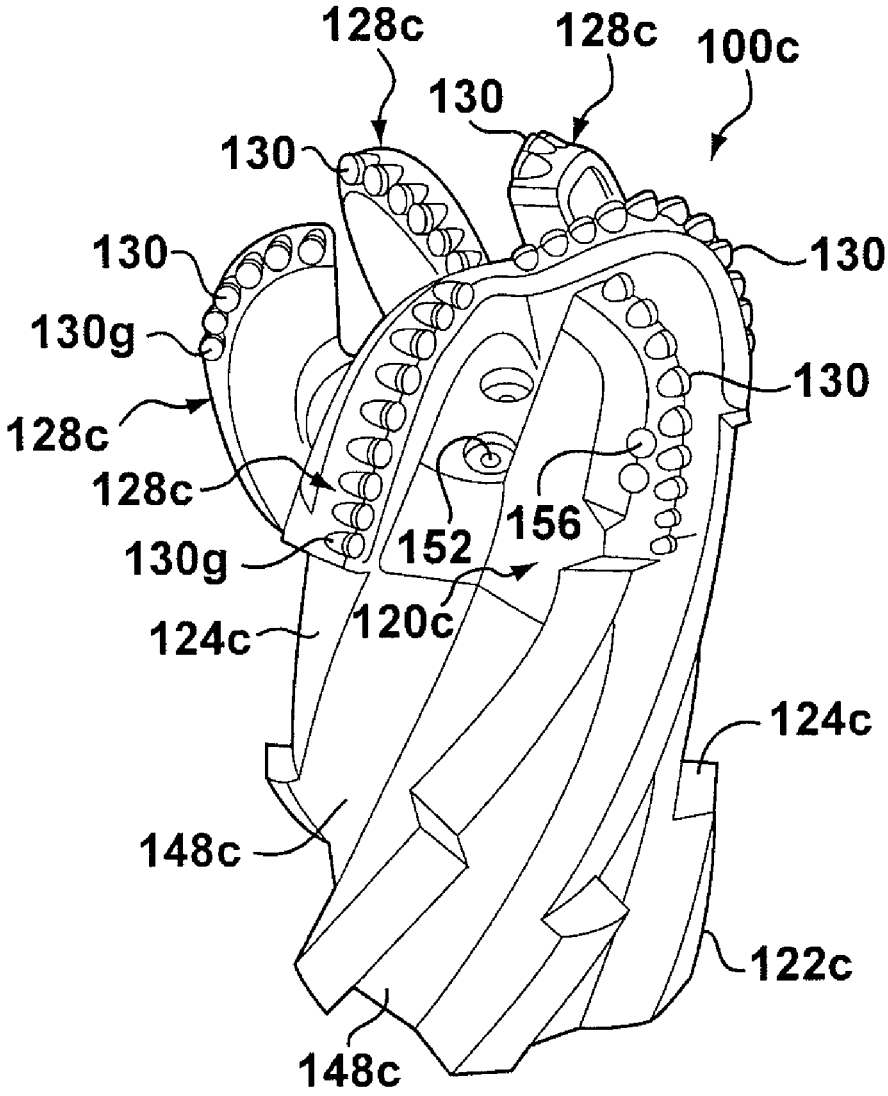
FIG. 3C is a schematic drawing showing an isometric view of a rotary drill bit having various design features which may be optimized for use with a point-the-bit directional drilling system in accordance with teachings of the present disclosure.

FIG. 3C is a schematic drawing showing one example of a rotary drill bit which may be designed in accordance with teachings of the present disclosure. Rotary drill bit 100*c* may be generally described as a fixed cutter drill bit. For some applications rotary drill bit 100*c* may also be described as a matrix drill bit steel body drill bit and/or a PDC drill bit. Rotary drill bit 100*c* may include bit body 120*c* with shank 122*c*.

Shank 122*c* may include under gage blade portions 124*c* formed in the exterior thereof. Shank 122*c* may also include extensions of associated blades 128*c*. As shown in FIG. 3C blades 128*c* may extend at an especially large spiral or angle relative to an associated bit rotational axis.

One of the characteristics of rotary drill bits used with point-the-bit directional drilling systems may be relatively increased length of associated gage surfaces as compared with push-the-bit directional drilling systems.

A longitudinal bore (not expressly shown) may extend through shank 122*c* and into bit body 120*c*. The longitudinal bore may be used to communicate drilling fluids from an associated drilling string to one or more nozzles 152 disposed in bit body 120*c*.

A plurality of cutter blades 128*e* may be disposed on the exterior of bit body 120*c*. Respective junk slots or fluid flow slots 148*c* may be formed between adjacent blades 128*c*. Each cutter blade 128*c* may include a plurality of cutters 130*g*. For some applications cutters 130*g* may also be described as "cutting inserts". Cutters 130*g* may be formed from very hard materials associated with forming a wellbore in a downhole formation. The exterior portions of bit body 120*c* opposite from shank 122*c* may be generally described as having a "bit face profile" as described with respect to rotary drill bit 100*c*. For some applications rotary drill bit 100*c* may also be described as a matrix drill bit and/or a PDC drill bit. Rotary drill bit 100*c* may include bit body 120*c* with shank 122*c*.

The shank may include bit breaker slots (not shown) formed on the exterior thereof. Pin threaded connection (not shown) may be formed as an integral part of shank 122*c* extending from bit body 120*c*. Various types of threaded connections, including but not limited to, API connections and premium threaded connections may be formed on the exterior of shank 122*c*.

Blades 128*c* may also spiral or extend at an angle relative to the associated bit rotational axis. For some applications bit body 120*c* may be formed in part from a matrix of very hard materials associated with rotary drill bits. For other applications bit body 120*c* may be machined from various metal alloys satisfactory for use in drilling wellbores in downhole formations. Examples of matrix type drill bits are shown in U.S. Pat. Nos. 4,696,354 and 5,099,929.

Figure 4:
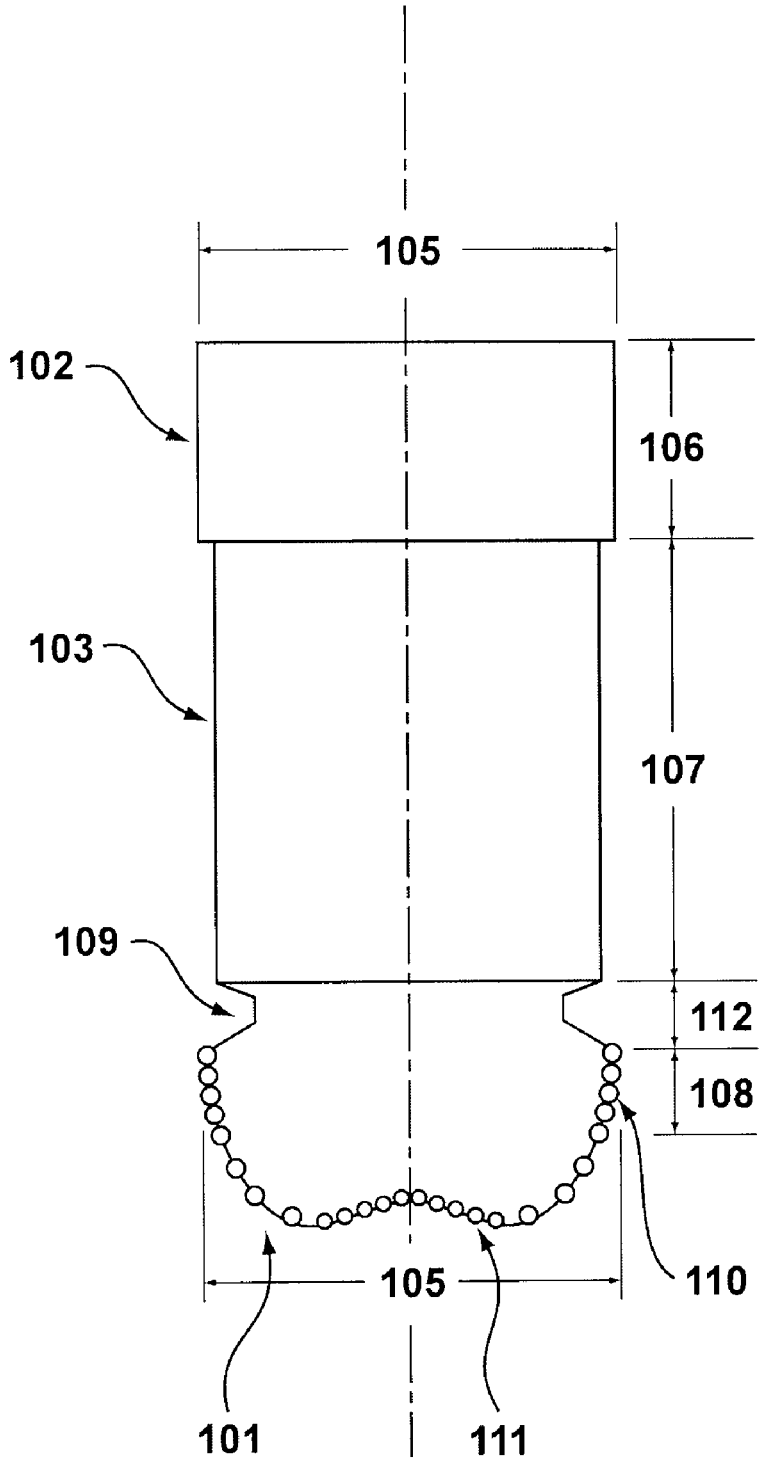
FIG. 4 is a side view of a bit having cutting, neck, clearance, and heel sections.

FIG. 4 is a side view of a rotary drill bit of the present invention. Rotary drill bit 100 has cutting section 101, heel section 102 and clearance section 103. Cutting section 101 is joined to clearance section 103 via neck section 109, wherein neck section 109 has a smaller outside diameter than clearance section 103. Cutting section 101 may have shallow cone profile 111 and aggressive gage cutters 110. Cutting section 101 may have six blades with PDC cutters positioned thereon. Clearance section 103 may have three blades with a high spiral pattern. Heel section 102 may also have three blades with a high spiral pattern. The blades of heel section 102 may be full gage 105 while the blades of the clearance section 103 may have an outside diameter less than full gage 105. Any number of blades may be used in the cutting, clearance and heel sections, respectively.

According to one embodiment of the invention, heel section 102 may have three blades that may be 2-3 inches wide with a high spiral. Also, the outside diameter of the blades may have full gage 105 of about 6.75 inches. Clearance section 103 may also have three blades about 2-3 inches wide with a high spiral. The outside diameter of the blades in clearance section 103 may be less than about 6.75 inches, in particular, about 6.6875 inches. Neck section 109 may have an outside diameter about 6.00 inches. At aggressive gage cutters 110, cutting section 101 may have full gage 105 diameter of about 6.75 inches. Heel section 102 may be about 2-4 inches in height 106, clearance section 103 may be about 5-7 inches in height 107, neck section 109 may be about 2-3 inches in height 112, and aggressive gage cutters 110 may be about 1-3 inches in height 108.

The bit may be designed so as to reduce the required side force needed to steer the bit. Three aspects may be considered for the design: a shallow cone and an aggressive shoulder and gage; less contact area of the gage pad with the wall; and less stress level in the top of the sleeve (around the fulcrum point) by increasing the contact area or reducing the contact force.

Figure 5A:
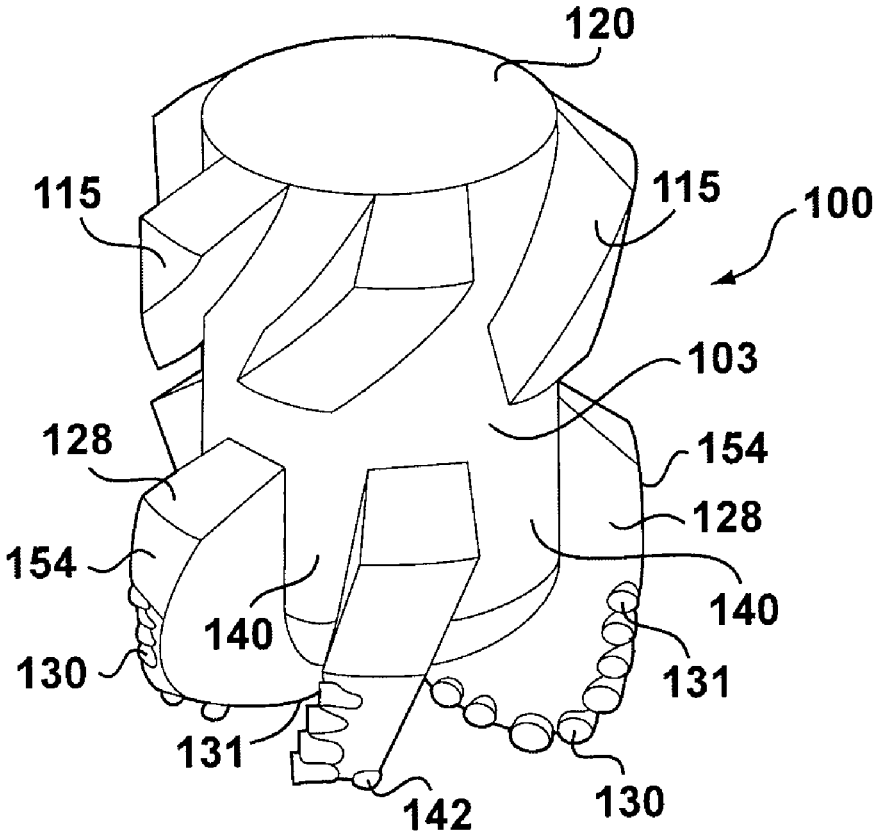
FIG. 5A is a perspective view of a bit having heel blades and a clearance section extending from the heel blades to a gage portion.

FIG. 5A is a schematic drawing showing rotary drill bit 100. Rotary drill bit 100 may include bit body 120 having a plurality of blades 128 with respective junk slots or fluid flow paths 140 formed therebetween. A plurality of cutting elements 130 may be disposed on the exterior portions of each blade 128. Each blade 128 may include respective gage surface or gage portion 154. Gage surface 154 may be an active gage and/or a passive gage. Respective gage cutter 131 may be disposed on each blade 128. A plurality of impact arrestors 142 may also be disposed on each blade 128. Additional information concerning impact arrestors may be found in U.S. Pat. Nos. 6,003,623, 5,595,252 and 4,889,017, incorporated herein by reference. Rotary drill bit 100 may also comprise heel blades 115, wherein the outside diameter of heel blades 115 approximately equal to the outside diameter of gage portion 154. Clearance section 103 is positioned between heel blades 115 and gage portion 154. Heel blades 115 have a high spiral, meaning that they twist around rotary drill bit 100 at a fairly high angle relative to the longitudinal central axis of the bit.

Figure 5B:
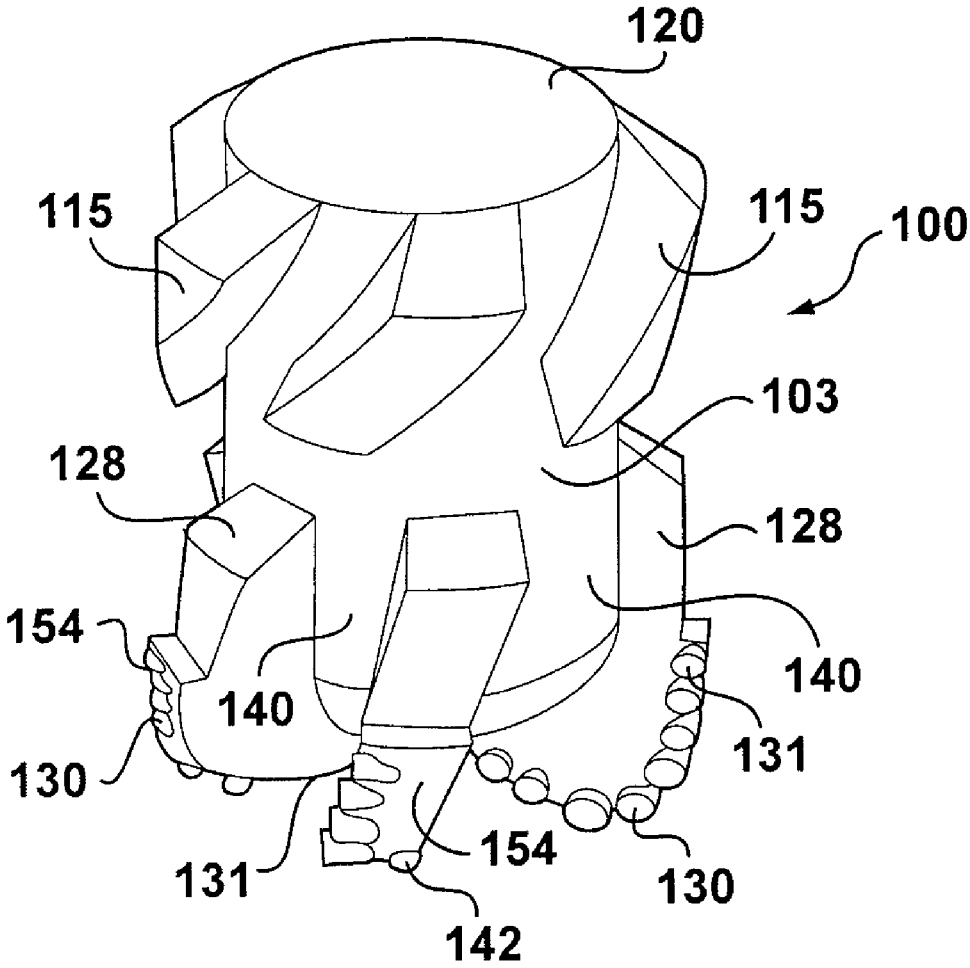
FIG. 5B is a perspective view of a bit having heel blades and a clearance section extending from the heel blades to the gage cutters.

FIG. 5B is a schematic drawing showing rotary drill bit 100, similar to that illustrated in FIG. 5A. Rotary drill bit 100 may include bit body 120 having a plurality of blades 128 with respective junk slots or fluid flow paths 140 formed therebetween. A plurality of cutting elements 130 may be disposed on the exterior portions of each blade 128. Each blade 128 may include respective gage surface or gage portion 154. Respective gage cutter 131 may be disposed on each blade 128. A plurality of impact arrestors 142 may also be disposed on each blade 128. Clearance section 103 is positioned between heel blades 115 and gage cutter 131. Blades 128 from the cutter section extend into the clearance section 103, but in clearance section 103, the blades have a smaller diameter, so as to allow the clearance section to extend all the way to gage cutter 131. Rotary drill bit 100 may also comprise heel blades 115, wherein the outside diameter of heel blades 115 approximately equal to the outside diameter of gage portion 154. Heel blades 115 have a high spiral, meaning that they twist around rotary drill bit 100 at a fairly high angle relative to the longitudinal central axis of the bit.

Figure 6A:
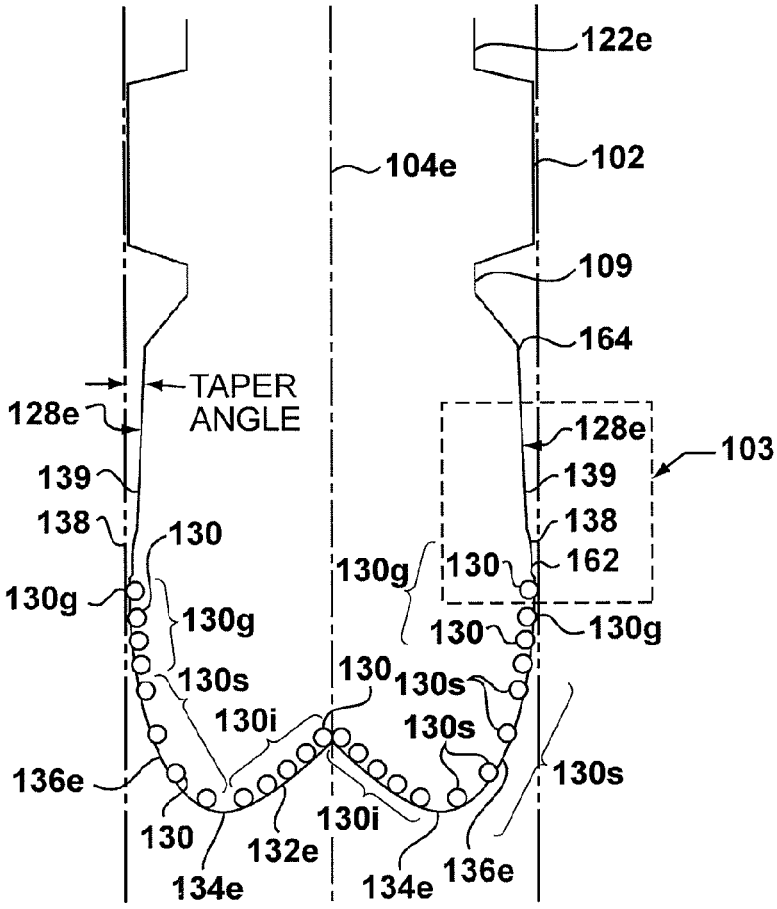
FIG. 6A is a schematic drawing in section with portions broken away showing another example of a rotary drill bit disposed within a wellbore.
Figure 6B:
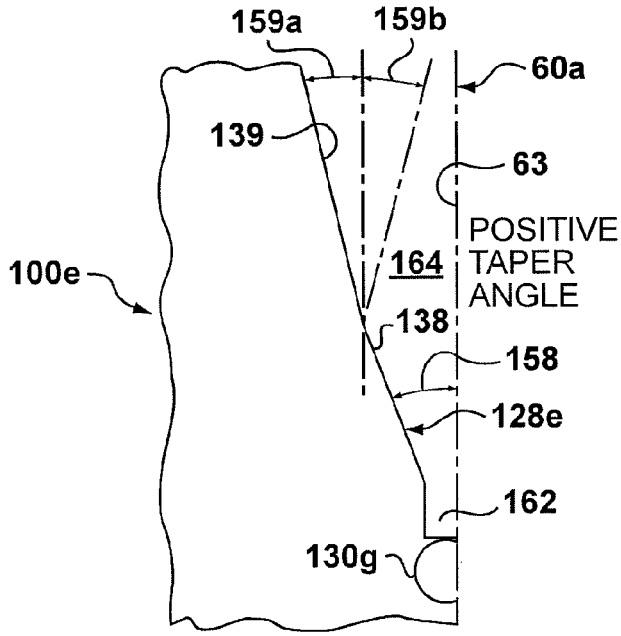
FIG. 6B is a schematic drawing showing various features of an active gage and a passive gage disposed on exterior portions of the rotary drill bit of FIG. 6A.

The bit face profile for rotary drill bit 100*e* as shown in FIGS. 6A and 6B may include recessed portion or cone shaped section 132*e* formed on the end of rotary drill bit 100*e* opposite from shank 122*e*. Each blade 128*e* may include respective nose 134*e* which defines in part an extreme end of rotary drill bit 100*e* opposite from shank 122*e*. Cone section 132*e* may extend inward from respective noses 134*e* toward bit rotational axis 104*e*. A plurality of cutting elements 130*i* may be disposed on portions of each blade 128*e* between respective nose 134*e* and rotational axis 104*e*. Cutters 130*i* may be referred to as "inner cutters".

Each blade 128*e* may also be described as having respective shoulder 136*e* extending outward from respective nose 134*e*. A plurality of cutter elements 130*s* may be disposed on each shoulder 136*e*. Cutting elements 130*s* may sometimes be referred to as "shoulder cutters." Shoulder 136*e* and associated shoulder cutters 130*s* cooperate with each other to form portions of the bit face profile of rotary drill bit 10*e* extending outward from cone shaped section 132*e*.

Gage cutters 130*g* and associated portions of each blade 128*e* form portions of the bit face profile of rotary drill bit 10*e* extending from shoulder cutters 130*s*.

For embodiments such as shown in FIGS. 6A and 6B each blade 128*e* may include active gage portion 138 and passive gage portion 139. Various types of hardfacing and/or other hard materials (not expressly shown) may be disposed on each active gage portion 138. Each active gage portion 138 may include a positive taper angle 158 as shown in FIG. 6B. Each passive gage portion may include respective positive taper angle 159*a* as shown in FIG. 6B.

The drill bit illustrated in FIGS. 6A and 6B also has heel section 102 with full gage 105 blades. Depending on the taper angle, the blades of heel section 102 may serves as the fulcrum point for taking the kick-off load from the side wall of the wellbore.

Since bend length associated with a point-the-bit directional drilling system is usually relatively small (less than 12 times associated bit size), most of the cutting action associated with forming a directional wellbore may be a combination of axial bit penetration, bit rotation and bit tilting. See FIGS. 3A and 3B. Rotary drill bits with positively tapered gages and/or gage gaps may be satisfactorily used with point-the-bit directional drilling systems.

Forming passive gage 139 with optimum negative taper angle 159*b* may result in contact between portions of passive gage 139 and adjacent portions of a wellbore to provide a fulcrum point to direct or guide rotary drill bit 10*e* during formation of a directional wellbore. The size of negative taper angle 159*b* may be limited to prevent undesired contact between passive gage 139 and adjacent portions of sidewall 63 during drilling of a vertical or straight hole segments of a wellbore. Steerability and controllability may be optimized by adjusting the length of passive gages with negative taper angles. For example, forming a passive gage with a negative taper angle on a rotary drill bit in accordance with teachings of the present disclosure may allow reducing the bend length of an associated rotary drill bit steering unit. The length of a bend subassembly included as part of the directional steering unit may be reduced as a result of having a rotary drill bit with an increased length in combination with a passive gage having a negative taper angle.

A passive gage having a negative taper angle may facilitate tilting of an associated rotary drill bit during kick off drilling. Installing one or more gage cutters at optimum locations on an active gage portion and/or passive gage portion of a rotary drill bit may also serve to remove formation materials from the inside diameter of an associated wellbore during a directional drilling phase. These gage cutters may not contact the sidewall or inside diameter of a wellbore while drilling a vertical segment or straight hole segment of the directional wellbore.

Passive gage 139 with an appropriate negative taper angle 159*b* and an optimum length may contact sidewall 63 during formation of an equilibrium portion and/or kick off portion of a wellbore. Such contact may substantially improve steerability and controllability of a rotary drill bit. Multiple tapered gage portions and/or variable tapered gage portions may be satisfactorily used with both point-the-bit and push-the-bit directional drilling systems.

Figure 7A:
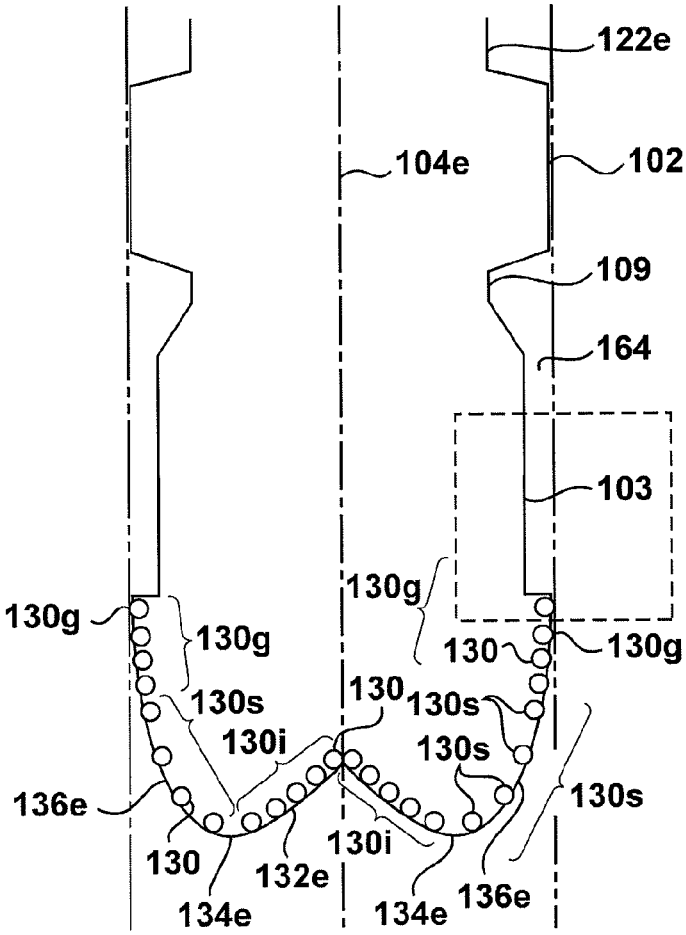
FIG. 7A is a schematic drawing in section with portions broken away showing another example of a rotary drill bit disposed within a wellbore.
Figure 7B:
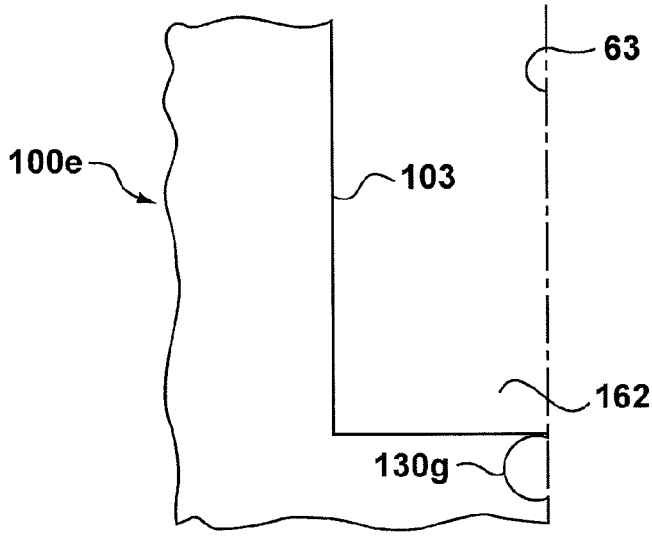
FIG. 7B is a schematic drawing showing various features of a clearance section disposed on exterior portions of the rotary drill bit of FIG. 7A.

FIGS. 7A and 7B illustrate a bit of the present invention similar to the one illustrated with reference to FIGS. 6A and 6B, except that this bit does not have a taper angle or active gage portion 138. Rather, the bit has clearance section 103 that has a constant diameter from immediately adjacent to gage cutters 130*g* to immediately adjacent heel section 102. Bit may also have neck section 109 between clearance section 103 and heel section 102.

Although the present disclosure and its advantages have been described in detail, it should be understood that various changes, substitutions and alternations may be made herein without departing from the spirit and scope of the disclosure as defined by the following claims.

What is claimed is:

1. A drill bit comprising:

a bit body having a diameter;

a cutting section disposed on the bit body and comprising gage cutting inserts, wherein in the cutting section is a first end of the bit body, and wherein the cutting section has a full gage diameter;

a heel section disposed on the bit body and comprising a blade, wherein the heel section is at an end of the drill bit opposite the cutting section, and wherein a diameter of the heel section is a full gage diameter; and a clearance section between the cutting and heel sections, wherein the clearance section comprises a diameter greater than the diameter of the bit body and less than full gage, and wherein the clearance section extends from the gage cutting inserts of the cutting section to the blade of the heel section.

2. A drill bit as claimed in claim 1, wherein the cutting section comprises a blade wherein the gage cutting inserts extend from the blade.

3. A drill bit as claimed in claim 1, wherein the heel section comprises a plurality of blades.

4. A drill bit as claimed in claim 1, wherein the heel section comprises a blade having a high spiral around the bit.

5. A drill bit as claimed in claim 1, wherein the heel section comprises a plurality of blades having a high spiral around the bit.

6. A drill bit as claimed in claim 1, wherein the clearance section comprises a blade having a high spiral around the bit.

7. A drill bit as claimed in claim 1, wherein the clearance section comprises a plurality of diameters.

8. A drill bit comprising:

a bit body having a diameter;

a cutting section disposed on the bit body and comprising gage cutting inserts, wherein in the cutting section is a first end of the bit, and wherein the cutting section has a full gage diameter;

a heel section disposed on the bit body and comprising a blade, wherein the heel section is at an end of the drill bit opposite the cutting section, and wherein a diameter of the heel section is a full gage diameter, and wherein the blade has a high spiral around the drill bit; and a clearance section between the cutting and heel sections, wherein the clearance section comprises a diameter greater than the diameter of the bit body and less than full gage.

9. A drill bit as claimed in claim 8, wherein the cutting section comprises a blade wherein the gage cutting inserts extend from the blade.

10. A drill bit as claimed in claim 8, wherein the heel section comprises a plurality of blades.

11. A drill bit as claimed in claim 8, wherein clearance section extends from the gage cutting inserts of the cutting section to the blade of the heel section.

12. A drill bit as claimed in claim 8, further comprising a neck section between the clearance section and the cutting section.

13. A drill bit as claimed in claim 8, further comprising a neck section between the heel section and the clearance section.

14. A drill bit as claimed in claim 8, wherein the clearance section comprises a plurality of diameters.

15. A drill bit as claimed in claim 8, wherein the heel section comprises a plurality of blades separated by slots, wherein a width of a blade is greater than a width of a slot.

16. A method for steering a rotary drill bit, the method comprising:

running a bottom hole assembly and an articulating drill bit into a wellbore, wherein the drill bit comprises a bit body having a diameter, a cutting section, a heel section and a clearance section, wherein the cutting and heel sections comprise diameters about full gage and the clearance section comprises a diameter greater than the diameter of the bit body and less than full gage, and wherein the clearance section extends from gage cutting inserts of the cutting section to a blade of the heel section;

articulating the drill bit relative to the bottom hole assembly; and kicking the heel section of the drill bit off a wellbore side wall.

17. A method as claimed in claim 16, wherein kicking comprises contacting a blade of the heel section with the wellbore side wall, wherein the blade has a high spiral around the drill bit.

18. A method as claimed in claim 16, further comprising reducing contact of the clearance section of the bit with the well bore side wall during the kicking of the heel section off the well bore side wall.

* * * * *